US008023841B2

(12) United States Patent
Ishikawa

(10) Patent No.: US 8,023,841 B2
(45) Date of Patent: Sep. 20, 2011

(54) FIXING CONTROLLER AND IMAGE FORMING APPARATUS

(75) Inventor: Junji Ishikawa, Moriya (JP)

(73) Assignee: Canon Kabushiki Kaisha (JP)

( * ) Notice: Subject to any disclaimer, the term of this patent is extended or adjusted under 35 U.S.C. 154(b) by 61 days.

(21) Appl. No.: 12/618,439

(22) Filed: Nov. 13, 2009

(65) Prior Publication Data

US 2010/0124429 A1 May 20, 2010

(30) Foreign Application Priority Data

Nov. 18, 2008 (JP) ..... 2008-294427

(51) Int. Cl.
*G03G 15/20* (2006.01)

(52) U.S. Cl. ..... 399/33; 399/69

(58) Field of Classification Search ..... 399/33, 399/67, 69
See application file for complete search history.

(56) References Cited

U.S. PATENT DOCUMENTS 4,104,692 A * 8/1978 Sudo et al. ..... 399/33 X
4,745,430 A * 5/1988 Tsuchiya ..... 399/33
7,372,008 B2 * 5/2008 Ohta et al. ..... 219/619
7,587,147 B2 * 9/2009 Mashiba ..... 399/33
7,609,984 B2 * 10/2009 Aoki et al. ..... 399/33
2006/0210293 A1 * 9/2006 Sone et al. ..... 399/69
2007/0122170 A1 * 5/2007 Mashiba ..... 399/33
2007/0242959 A1 * 10/2007 Aono et al. ..... 399/69 X

FOREIGN PATENT DOCUMENTS

JP 2005-024934 A 1/2005
JP 2005-338698 A 12/2005

* cited by examiner

*Primary Examiner* — Sandra Brase
(74) *Attorney, Agent, or Firm* — Rossi, Kimms & McDowell LLP

(57) ABSTRACT

A fixing controller capable of rapidly detecting an excessive temperature rise, even if an abnormal temperature rise takes place in a state that a rotor of a fixing unit, such as a thin-walled roller or belt, stops rotating. A rotating belt is heated by a coil, a belt temperature is detected by a thermistor, and a drive frequency of a driving circuit for driving the coil is controlled by a control circuit. When the temperature detected by the thermistor becomes equal to or higher than a predetermined temperature, the drive circuit is stopped by an excessive temperature rise detecting circuit. The thermistor is heated such that a difference between the temperatures detected by the thermistor when the belt is rotating and when the belt stops rotating becomes equal to or larger than a predetermined temperature difference.

6 Claims, 10 Drawing Sheets

FIXING CONTROLLER AND IMAGE FORMING APPARATUS

BACKGROUND OF THE INVENTION

1. Field of the Invention

The present invention relates to a fixing controller and an image forming apparatus including the same.

2. Description of the Related Art

An image forming apparatus generally includes a fixing unit for thermally melting toner of toner image, which is transferred but unfixed to a sheet, and for fixing the toner image onto the sheet.

There are known fixing units configured to rapidly raise the toner temperature, e.g., by having a thin-walled small diameter fixing roller (heating medium) or by having a heating member disposed inside and in contact with a rotor. In recent years, a fixing unit of an electromagnetic induction heating type has also been used that has a thin-walled metallic rotor for generating heat by induction heating. Each of these fixing units includes a rotor (heating medium or heat-generating medium) configured to have a small thermal capacity so as to be efficiently heated by a heat source.

For image forming apparatuses, e.g., copying machines, there have been proposed various fixing units of a type having a thin-walled rotor made in contact with a sheet so as to heat and melt a toner on the sheet.

However, in a case that the thin-walled rotor, which is small in thermal capacity, is used as a heating medium and heat is locally generated by, e.g., electromagnetic induction heating, it is difficult to achieve satisfactory heat transfer from a heat generating part to other parts. Such a tendency becomes more noticeable when the rotor is made thinner to shorten a warm-up period.

The above unsatisfactory heat transfer does not cause a problem in a case that the rotor rotates during heating. On the other hand, if the rotor stops rotating during the heating, this is equivalent to the heat generating part becoming further smaller in thermal capacity, which results in a rapid temperature rise.

In a case that the rotor stops rotating during heating, the speed of detection by temperature detecting means lags behind the speed of temperature rise. As a result, when an abnormal temperature rise takes place, there occurs a delay in the timing of excessive temperature rise detection for stopping the heating, which poses a problem that the fixing unit can be damaged.

For example, such a delay in excessive temperature rise detection causes a fear that peripheral members made of resin are shortened in heat life and thermally damaged.

In this regard, Japanese Laid-open Patent Publication No. 2005-338698 proposes a fixing unit of local heating type, which is configured to have a small heat capacity by using a thin-walled roller or belt. The proposed fixing unit has a heating member, held by a film support disposed in a cylindrical film, for heating a sheet passing between the cylindrical film and a pressure roller which is in pressure contact with the cylindrical film. This fixing unit controls the temperature of the heating member to a predetermined temperature based on the heating member temperature detected by a thermistor (temperature detecting means), and determines the possibility of occurrence of a slip between the film and the sheet on the basis of temperature rise speed.

Japanese Laid-open Patent Publication No. 2005-24934 proposes a technique for detecting a speed detection pattern formed on a belt by an optical rotation detecting means to detect a belt drive speed, and determining whether the belt rotates or stops rotating based on the detected speed.

The fixing units proposed in Japanese Laid-open Patent Publication Nos. 2005-338698 and 2005-338698 are each configured to stop the heating operation when it is determined that a slip takes place between film and sheet or when the belt does not rotate normally due to, e.g., abnormality of a driving motor.

However, with the slip determination based on the temperature rise speed, an occurrence of slip can be determined if the slip takes place during temperature rise from a low temperature to a target temperature, but cannot accurately be determined if the slip takes place after the film is already heated up to some extent.

With the technique of detecting the belt rotation by the rotation detecting means, it is necessary to newly add the rotation detecting means, resulting in increase in cost and size. In addition, the rotation detecting means for use in high temperature environment is difficult to install.

SUMMARY OF THE INVENTION

The present invention provides a fixing controller and an image forming apparatus having the same, which are capable of rapidly detecting an excessive temperature rise, even if an abnormal temperature rise takes place in a state that a rotor such as a thin-walled roller or belt stops rotating.

According to a first aspect of this invention, there is provided a fixing controller, which comprises a first heating unit configured to heat a rotor of a fixing unit, a temperature detecting unit configured to detect a temperature of the rotor at its portion heated by the first heating unit, a second heating unit configured to heat the temperature detecting unit, and a control unit configured to stop the first heating unit from heating the rotor in a case where the temperature detected by the temperature detecting unit becomes equal to or higher than a predetermined temperature, wherein the temperature detecting unit is heated by the second heating unit such that a difference between the temperatures respectively detected by the temperature detecting unit when the rotor is rotating and when the rotor stops rotating becomes equal to or larger than a predetermined temperature difference.

According to a second aspect of this invention, there is provided a fixing controller, which comprises a first heating unit configured to heat a rotor of a fixing unit, a plurality of temperature detecting units each configured to detect a temperature of the rotor at its portion heated by the first heating unit, a second heating unit configured to heat one of the plurality of temperature detecting units, and a control unit configured to stop the first heating unit from heating the rotor in a case where a difference between the temperatures respectively detected by the plurality of temperature detecting units becomes equal to or greater than a predetermined temperature difference, wherein the one of the plurality of temperature detecting units is heated by the second heating unit such that the difference between the temperatures respectively detected by the plurality of temperature detecting units when the rotor stops rotating becomes equal to or greater than the predetermined temperature difference.

According to third and fourth aspects of this invention, there are provided image forming apparatuses respectively including the fixing controllers according to the first and second aspects of this invention.

With the present invention, it is possible to rapidly detect an excessive temperature rise, even if an abnormal temperature rise takes place in a state that a rotor such as a thin-walled roller or belt stops rotating.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

Figure 1:
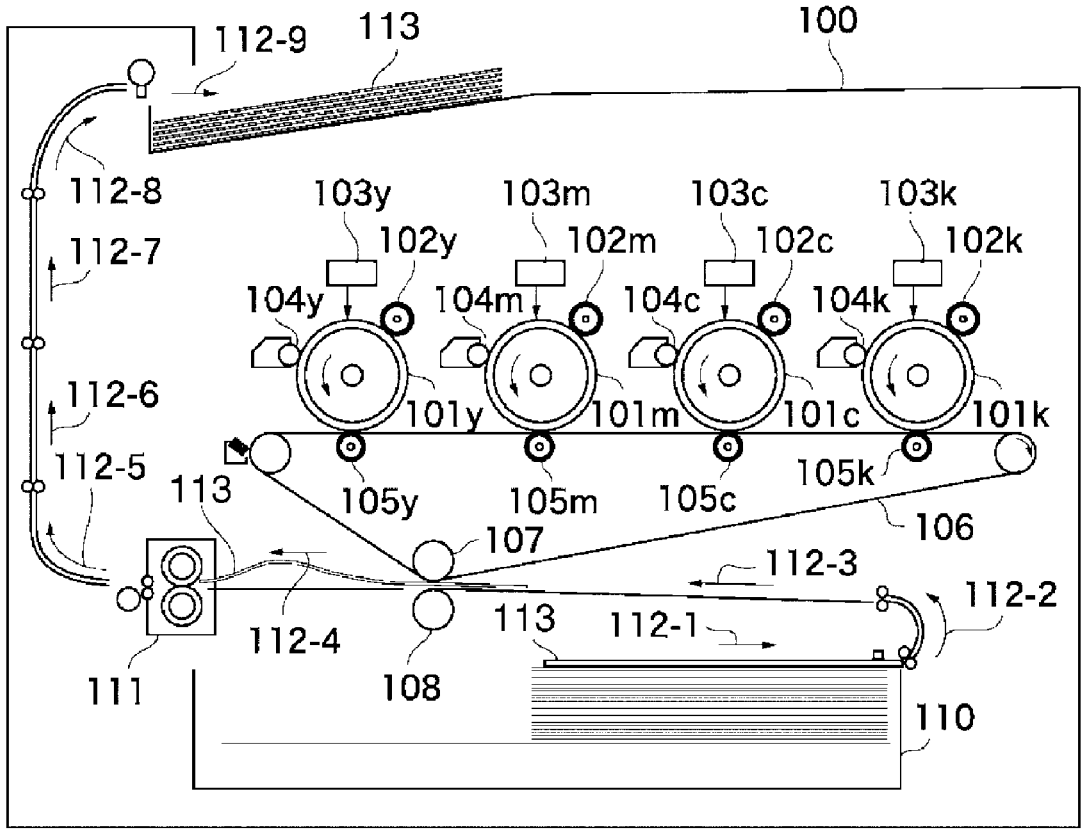
FIG. 1 is a schematic view showing the construction of an image forming apparatus according to one embodiment of this invention.

FIG. 1 shows the construction of an image forming apparatus according to one embodiment of this invention.

In FIG. 1, there is shown an apparatus main unit 100 having the following component parts, which will be described together with their operations.

The apparatus main unit 100 includes a photosensitive member 101*y* that rotates counterclockwise in FIG. 1 and a primary charging roller 102*y* that uniformly negatively charges a surface of the photosensitive member 101*y*. A voltage having a DC component and an AC component superimposed thereon is applied to the primary charging roller 102*y* to uniformly charge the photosensitive member 101*y*. The DC component ranges from minus 300 V to minus 900 V, and the AC component ranges from 130 V to 2000 V.

In most cases, a high voltage generator having a high voltage transformer is used to generate the DC and AC component voltages. Usually, the high voltage transformer generates the DC and AC component voltages from, e.g., a voltage of 24 V for operation of motors in the apparatus main unit 100.

The uniformly charged surface of the photosensitive member 101*y* is exposed to laser irradiated from a laser unit 103*y*. The impedance of exposed parts of the charged surface decreases, and the charge amount thereon decreases.

The laser unit 103*y* is ON/OFF controlled or PWM-controlled for control of exposure, whereby a latent image is drawn on the surface of the photosensitive member 101*y* according to a charge amount distribution thereon.

A developing sleeve 104*y* is disposed to face a circumferential surface of the photosensitive member 101*y*. A gap between the developing sleeve 104*y* and the photosensitive member 101*y* is accurately managed. An electric field is generated between the surface of the photosensitive member 101*y* and the developing sleeve 104*y* by applying to the developing sleeve 104*y* a high voltage having a DC component ranging from minus 150 V to minus 700V and an AC component ranging from 1000 V to 2000 V.

As with the charging process, the DC and AC component voltages for the developing process are generated by a high voltage generator having a high voltage transformer. In the developing process, the waveform of the AC component voltage greatly affects the quality of image.

The direction and strength of the electric field are affected by the amount of charge. Specifically, at a part of the surface of the photosensitive member 101*y* which is not exposed to the laser and hence large in the amount of negative charge, the electric field is generated which is directed from the developing sleeve 104*y* to the photosensitive member 101*y*.

On the other hand, at a part of the surface of the photosensitive member 101*y* which is intensively exposed to laser and small in the amount of charge, the electric field is generated which is directed from the photosensitive member 101*y* to the developing sleeve 104*y*.

A negatively charged yellow toner on the developing sleeve 104*y* is applied with a force acting in a direction opposite from the direction of the electric field generated between the surface of the photosensitive member 101*y* and the developing sleeve 104*y*. As a result, the latent image formed on the photosensitive member 101*y* according to the charge amount distribution is developed by the yellow toner according to the direction and intensity of the electric field, whereby a toner image is formed.

An intermediate transfer belt 106 is disposed in contact with the surface of the photosensitive member 101*y*. On a side of the intermediate transfer belt 106 opposite from the photosensitive member 101*y*, there is disposed a primary transfer roller 105*y* to which a voltage ranging from plus 200V to plus 1500V is applied. Accordingly, the negatively charge yellow toner on the photosensitive member 101*y* is attracted toward the primary transfer roller 105*y*. As a result, the yellow toner on the surface of the photosensitive member 101*y* is transferred onto the surface of the intermediate transfer belt 106.

Magenta, cyan, and black toners are similarly transferred onto the surface of the intermediate transfer belt 106. In FIG. 1, suffixes of m, c, and k respectively denote units for magenta, cyan, and black. These units correspond to the photosensitive member 101*y*, primary charging roller 102*y*, laser unit 103*y*, developing sleeve 104*y*, and primary transfer roller 105*y*.

Thus, a full color image formed by yellow, magenta, cyan, and black toners is formed on the intermediate transfer belt 106. Then, the intermediate transfer belt 106 passes between secondary transfer inner and outer rollers 107, 108. At that time, a sheet 113 is sandwiched and transferred between the intermediate transfer belt 106 and the secondary transfer outer roller 108.

Since a voltage ranging from plus 500 V to plus 7000 V is applied to the secondary transfer outer roller 108, the negatively charged toners on the intermediate transfer belt 106 are transferred to an upper surface of the sheet 113. The sheet 113 is fed from a sheet cassette 110 and conveyed as shown by arrows 112-1 to 112-4.

The toners on the surface of the sheet 113 having passed between the secondary transfer inner and outer rollers 107, 108 are not fixed to the sheet 113 and hence liable to be peeled off therefrom. In this state, the sheet 113 is conveyed to the fixing unit 111 and heated to a high temperature, and the toners thereon are softened and then applied with pressure, whereby the toners are adhered and fixed to the surface of the sheet 113.

Next, the sheet 113 is conveyed and output as shown by arrows 112-5 to 112-9 and then stacked on the already stacked sheets.

Figure 2:
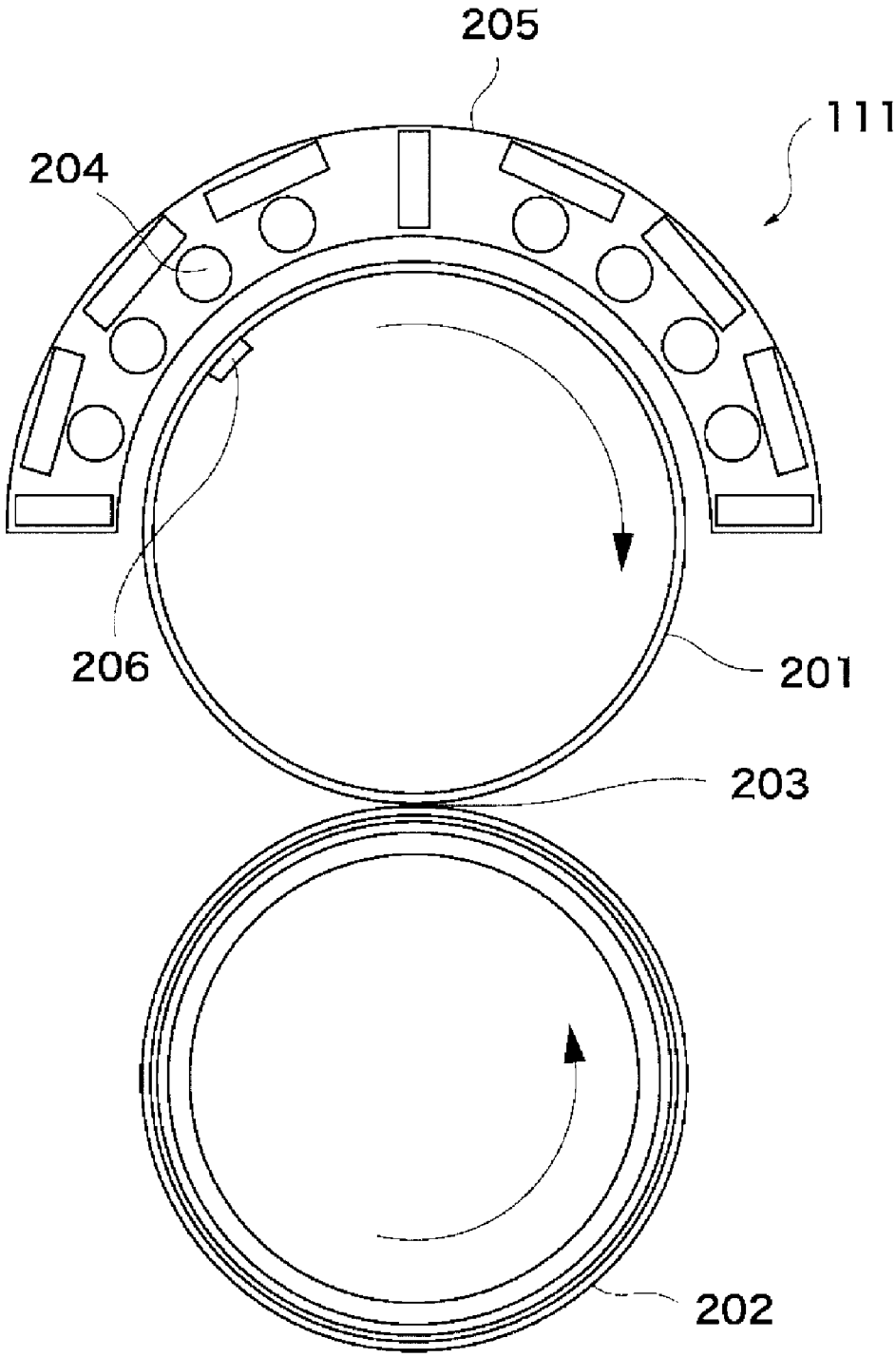
FIG. 2 is an enlarged fragmentary view showing the construction of a fixing unit shown in FIG. 1.

FIG. 2 shows the construction of the fixing unit 111. The fixing unit 111 is of an electromagnetic induction heating type.

As shown in FIG. 2, the fixing unit 111 has a cylindrical belt (rotor) 201 that includes an electrically conductive heat-generating element having a thickness of 45 μm and having a surface thereof covered by a rubber layer of 300 μm. A nip portion 203 is formed between the belt 201 and a drive roller 202. The belt 201 rotates in a direction shown by arrow with rotation of the drive roller 202, the rotation being conveyed from the nip portion 203 to the belt 201.

A coil (first heating unit) 204 is disposed inside a coil holder 205 so as to face the belt 201. The electrically conductive heat-generating element in the belt 201 self-heats when an AC current flows through the coil 204 to generate an electromagnetic field. The coil 204 is an induction heating coil that generates a high frequency magnetic field when applied with high frequency electric power.

A thermistor (temperature detecting unit) 206 is disposed in contact from inside with a heat generating part of the belt 201 and configured to detect a belt temperature.

Figure 3:
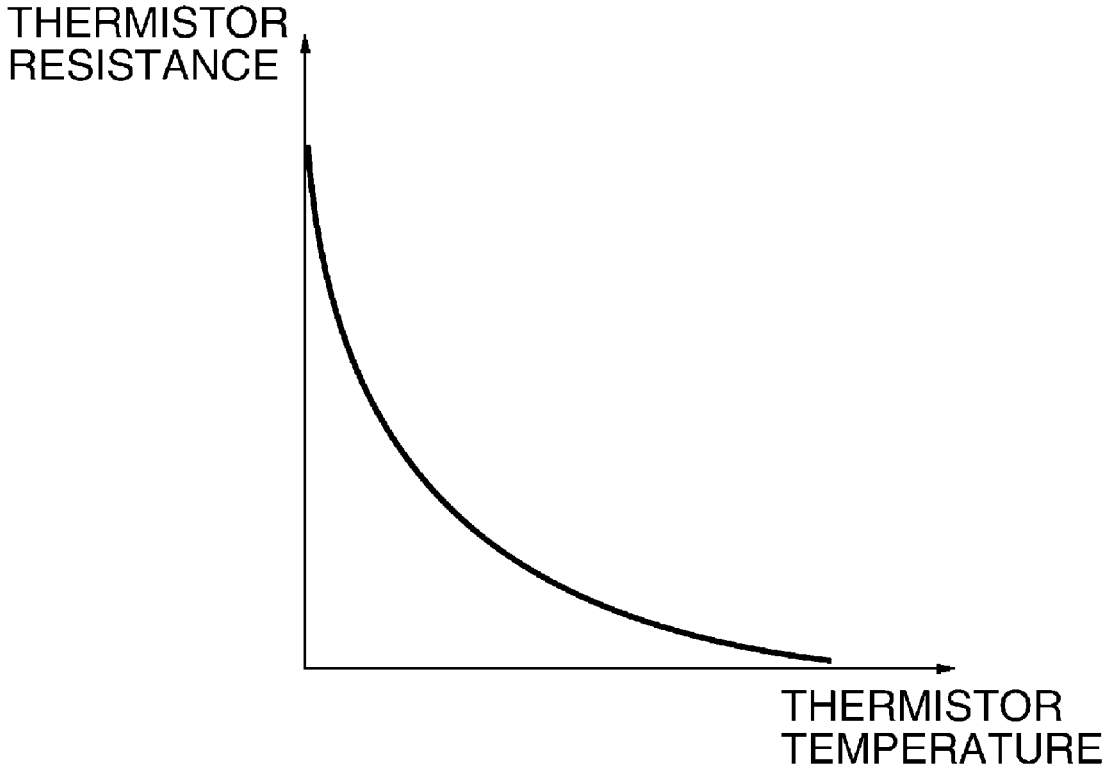
FIG. 3 is a graph showing a relationship between temperature and resistance of a thermistor of the fixing unit.

FIG. 3 shows a relationship between temperature and resistance of the thermistor 206.

The thermistor 206 is a resistor whose resistance becomes higher with the decrease in thermistor temperature as shown in FIG. 3. The fixing unit 111 increases or decreases the AC current flowing through the coil 24 such that the belt temperature detected by the thermistor 206 becomes equal to a target belt temperature of, e.g., 180 degrees C.

Figure 4:
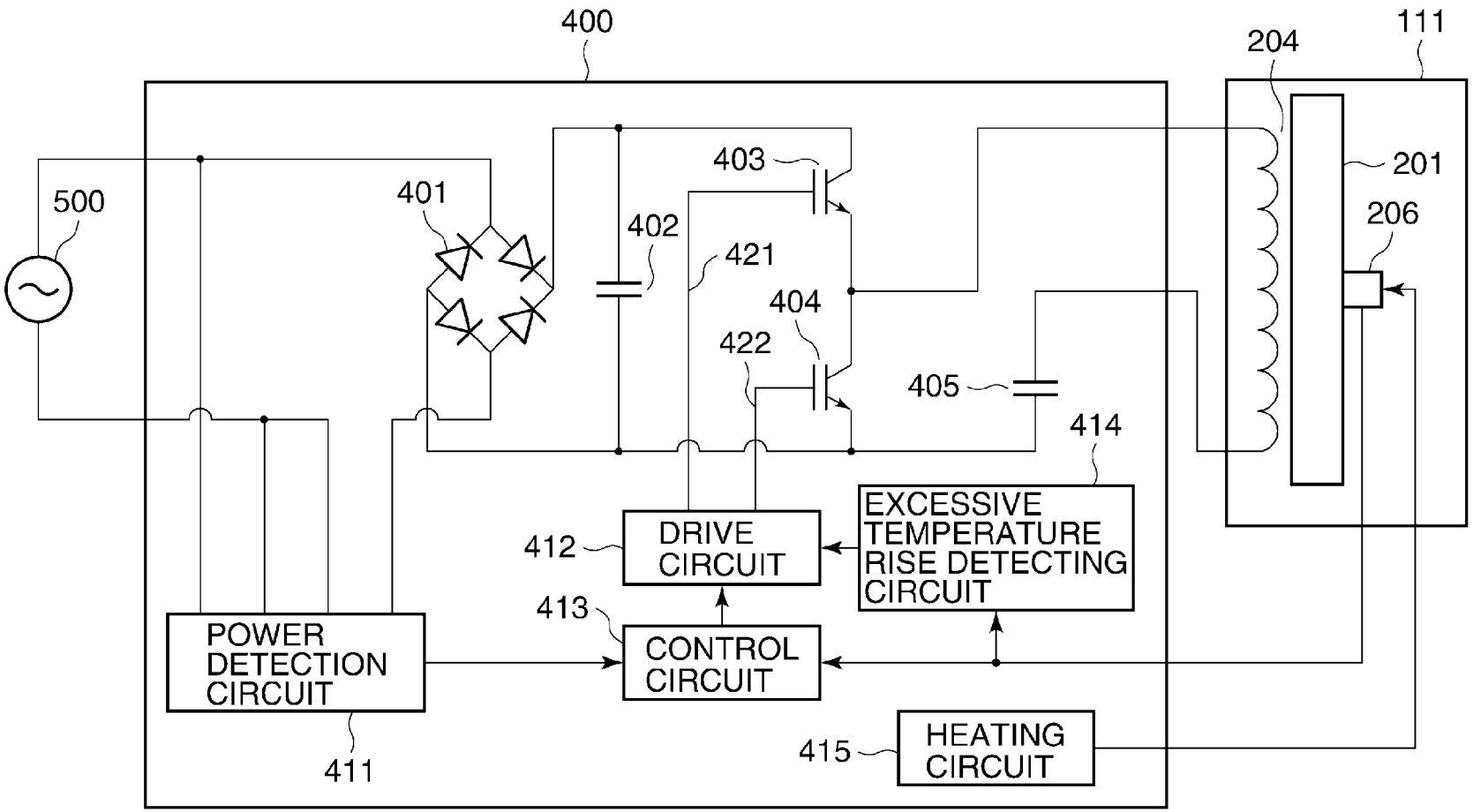
FIG. 4 is a block diagram showing a fixing controller according to a first embodiment of this invention.

FIG. 4 shows in block diagram a fixing controller according to a first embodiment of this invention.

As shown in FIG. 4, the fixing controller includes the coil 24 and the thermistor 206 provided in the fixing unit 111, and includes a power unit 400 that supplies an AC current to the coil 204.

The power unit 400 is connected with an AC power 500 such as a commercial power source, and includes a diode bridge 401, a capacitor 402, a resonant capacitor 405 that forms a resonant circuit, and first and second switch elements 403, 404.

The power unit 400 further includes a drive circuit 412 that drives the two switch elements 403, 404 with driving signals 421, 422, a control circuit 413, and a power detection circuit 411 that detects the power input from the AC power 500.

The power unit 400 further includes an excessive temperature rise detecting circuit 414 that determines whether the temperature detected by the thermistor 206 reaches a predetermined excessive temperature rise detection level (equal to or higher than a predetermined temperature), and forcibly stops the supply of AC current to the coil 204 when the excessive temperature rise detection level is reached.

The power unit 400 further includes a heating circuit (second heating unit) 415 for heating the thermistor 206. Based on a result of detection by the power detection circuit 411 and a result of detection by the thermistor 206, the control circuit 413 changes the frequency of the driving signals 421, 422 (drive frequency) within a predetermined maximum power range such that the temperature of the belt 201 becomes equal to the target belt temperature.

The switch elements 403, 404 are alternately turned ON/OFF in accordance with the driving signals 421, 422, and supply a high frequency current to the coil 204. The AC current flowing through the coil 204 has a frequency higher than the resonance frequency determined by inductances of the coil 204 and the belt 201 and a capacitance of the resonant capacitor 405. The AC current increases with the decrease in the frequency of the driving signals 421, 422, and decreases with the increase in the driving signal frequency. The increase and decrease in the AC current result in the increase and decrease in the magnetic field, which in turn result in the increase and decrease in heat value of the electrically conductive heat-generating element of the belt 201, whereby the temperature of the belt 201 can be controlled.

The thermistor 206 is heated by the heating circuit 415 such that a predetermined or greater temperature difference is produced between the temperatures respectively detected by the thermistor 206 when the belt 201 is rotating and when the belt 201 stops rotating.

Figure 5:
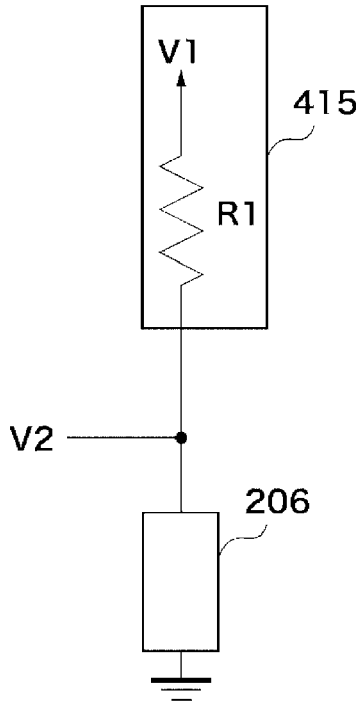
FIG. 5 is a view showing a first example of connection construction between a thermistor and a heating circuit shown in FIG. 4.

FIG. 5 shows a first example of connection construction between the thermistor 206 and the heating circuit 415.

As shown in FIG. 5, the heating circuit 415 has a resistor R1 connected in series with the thermistor 206 and connected to a reference voltage V1. The resistor R1 has a resistance of, e.g., 4.3 kΩ, which is substantially the same as a resistance of the thermistor 206 at a temperature of 210 degrees C. The reference voltage V1 has a value of 20 V, for example.

In this embodiment, the resistor R1 of the heating circuit 415 and the thermistor 206 constitute a voltage divider for obtaining a temperature detection signal (voltage V2 across the thermistor 206).

Figure 6:
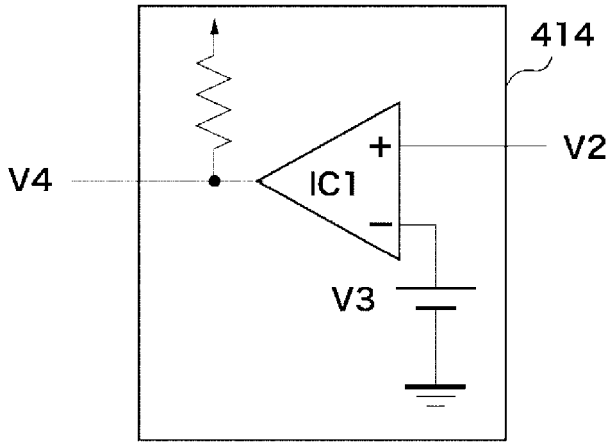
FIG. 6 is a view showing the construction of an excessive temperature rise detecting circuit in FIG. 4.
Figure 7:
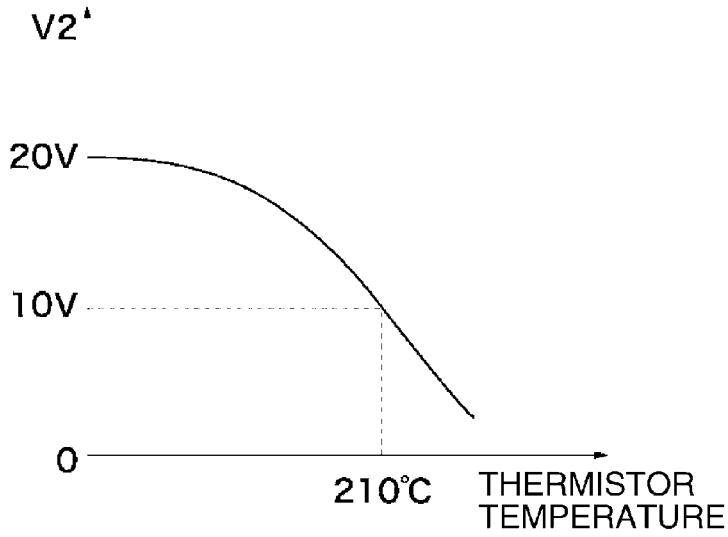
FIG. 7 is a graph showing an example relationship between temperature of the thermistor and voltage V2 across the thermistor.

FIG. 6 shows the construction of the excessive temperature rise detecting circuit 414 in FIG. 4, and FIG. 7 shows an example relationship between temperature of the thermistor 206 and voltage V2 across the thermistor 206.

As shown in FIG. 6, the excessive temperature rise detecting circuit 414 includes a comparator IC1 that compares the voltage V2 with an excessive temperature rise detection level V3, and causes a forced outage signal V4 to be high if a relation of V2<V3 is fulfilled. When the forced outage signal V4 is made high, the drive circuit 412 stops the drive of the switch elements 403, 404 regardless of whatever signal is supplied from the control circuit 413, whereby the AC current supply is stopped and heat generation is stopped accordingly.

When the belt 201 is rotating, a region of the belt 201 where the belt 201 is in contact with the thermistor 206 continuously changes whereby heat is continuously removed from the thermistor 206, resulting in a thermal resistance of, e.g., 25 degrees C./W. When the belt 201 stops rotating, the thermal conduction is deteriorated, resulting in a thermal resistance of, e.g., 500 degrees C./W.

Figure 8:
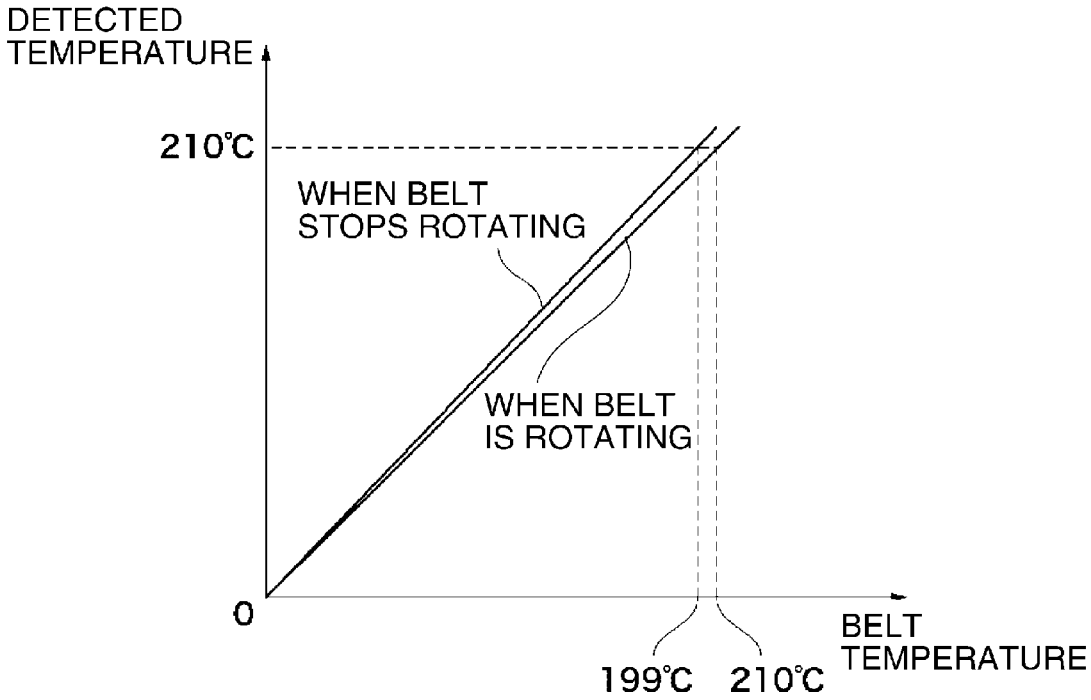
FIG. 8 is a graph showing an example relationship between belt temperature and temperature detected by the thermistor.

The thermistor 206 generates heat of, e.g., about 23 mW at near 210 degrees C., and therefore has a temperature which is substantially the same as the belt temperature when the belt is rotating. When the belt 201 stops rotating, the thermistor 206 has a temperature which is, e.g., about 11 degrees C. higher than the belt temperature. In other words, when the belt stops rotating, an actual temperature of the belt 201 is 199 degrees C., but a temperature of 210 degrees C. is detected by the excessive temperature rise detecting circuit 414 (see FIG. 8).

Next, a description will be given of a protective operation performed by the fixing controller when an abnormal temperature rise takes place.

Figure 9:
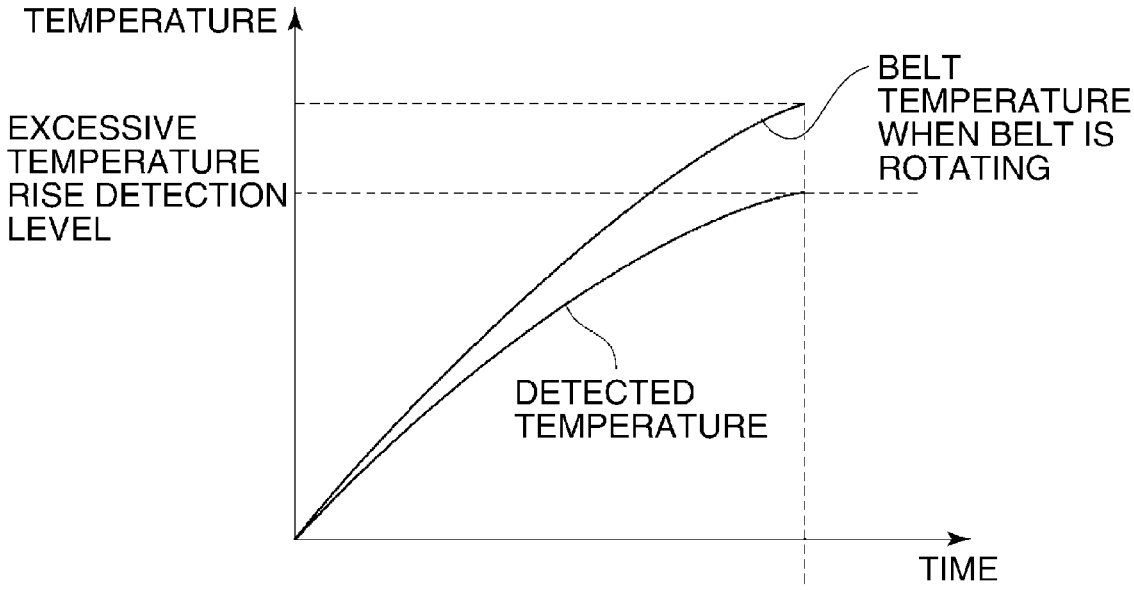
FIG. 9 is a graph of temperature curves showing time-dependent changes in belt temperature and in temperature detected by the thermistor when the belt is rotating.

FIG. 9 shows temperature curves showing changes in the belt temperature and in the temperature detected by the thermistor 206 with elapse of time, which are observed in a case where an abnormal temperature rise takes place while the belt 201 is rotating.

Upon occurrence of an abnormal temperature rise, the temperature of the belt 201 rapidly rises at a speed faster than heat conduction from the belt 201 to the thermistor 206, resulting in a delay in temperature detection by the thermistor 206. Nevertheless, when the belt 201 is rotating, the belt temperature rise is relatively moderate as compared to the heat conduction from the belt 210 to the thermistor 206, and therefore, the excessive temperature rise can be detected before peripheral members are damaged.

Figure 10:
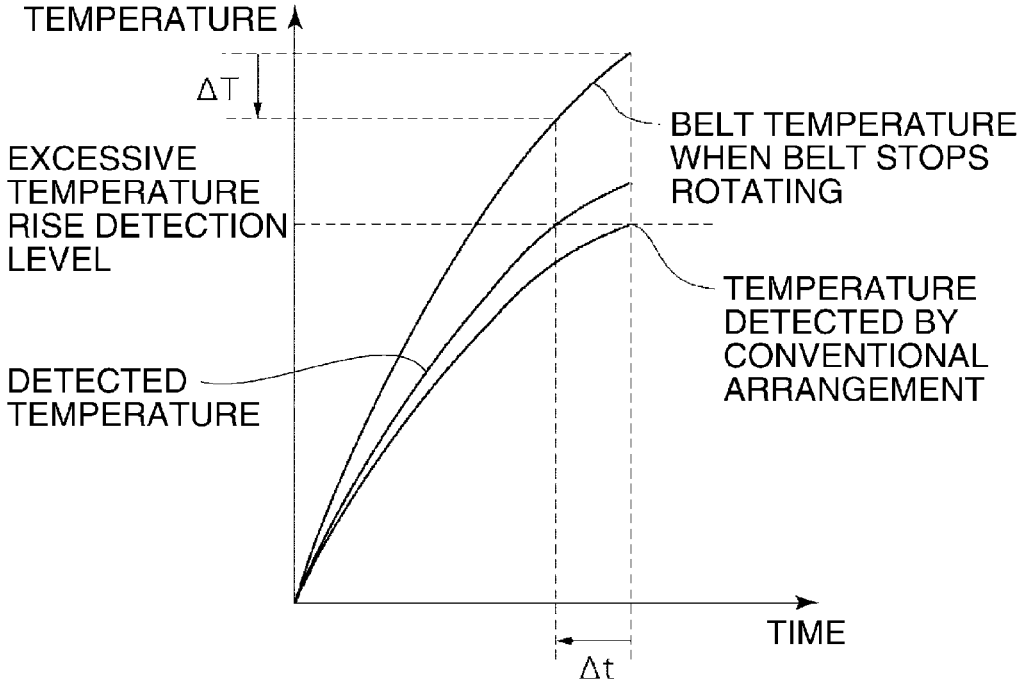
FIG. 10 is a graph showing temperature curves observed when the belt stops rotating.

FIG. 10 shows temperature curves showing changes in the belt temperature and in the temperature detected by the thermistor 206 with elapse of time, which are observed in a case where an abnormal temperature rise takes place while the belt 201 stops rotating.

In a state that the belt 201 stops rotating, the temperature of the belt 201 rapidly rises at a speed faster than that in a state where the belt 201 is rotating (see, FIGS. 9 and 10). Nevertheless, since the fixing controller of this embodiment is configured, as described previously, to obtain the voltage V2 indicative of the temperature detected by the thermistor 206 by dividing the reference voltage V1 by the thermistor 206 and the resistor R1 of the heating circuit 415, the temperature detected by the thermistor 206 when the belt stops rotating becomes higher than that detected by the conventional arrangement (see, FIG. 10).

As a result, the timing of detection of the excessive temperature rise becomes earlier by $\Delta t$ than that in the conventional arrangement as shown in FIG. 10, and therefore, a possible maximum temperature reached by the belt 201 can be reduced by $\Delta T$, whereby peripheral members can be prevented from being damaged.

Figure 11:
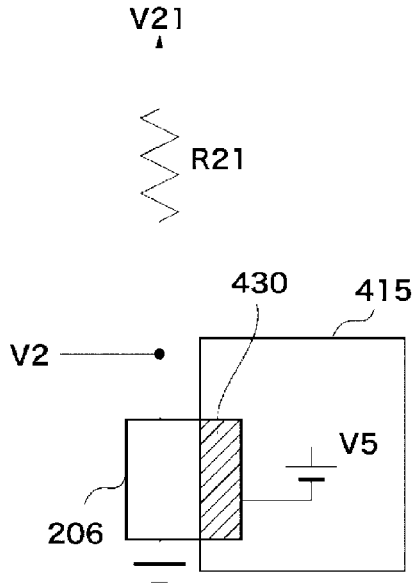
FIG. 11 is a view showing a second example of connection construction between the thermistor and the heating circuit shown in FIG. 4.

FIG. 11 shows a second example of connection construction between the thermistor 206 and the heating circuit 415 in FIG. 4.

Figure 12:
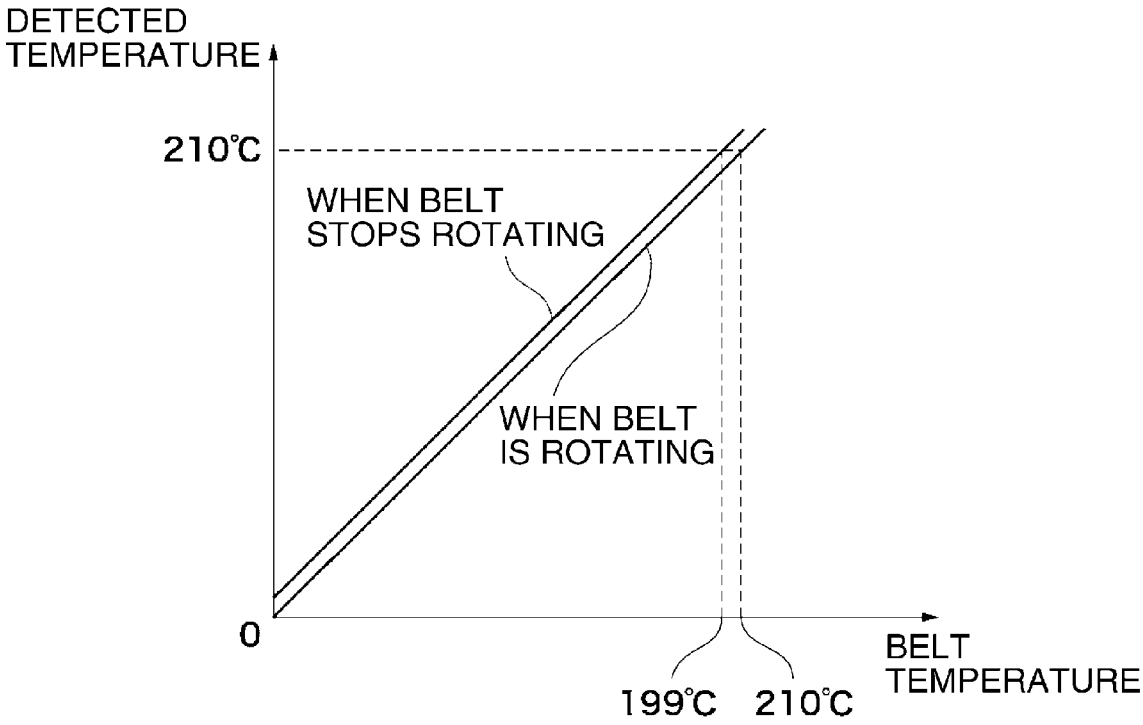
FIG. 12 is a graph showing an example relationship between belt temperature and temperature detected by the thermistor.

As shown in FIG. 11, the heating circuit 415 includes a heater 430 and a heater power source V5. The heater 430 is disposed in contact with or near the thermistor 206, and heats the thermistor 206 such that a difference is produced, as shown in FIG. 12, between the temperatures respectively detected by the thermistor 206 when the belt is rotating and when the belt stops rotating.

A resistor R21 is connected in series with the thermistor 206 and connected to a reference voltage V21. The resister R21 has a resistance of, e.g., 4.3 kΩ, and the reference voltage V21 has a value of, e.g., 3.3 V.

With the heating circuit 415 in FIG. 11, as with the heating circuit 415 in FIG. 5, the temperature of the thermistor 206 becomes substantially the same as the belt temperature when the belt 201 is rotating, but becomes about 11 degrees C. higher than the belt temperature when the belt stops rotating.

Specifically, if the actual temperature of the belt 201 has a value of 199 degrees C. when the belt stops rotating, the temperature detected by the excessive temperature rise detecting circuit 114 has a value of 210 degrees C. Accordingly, even if an abnormal temperature rise takes place in a state that the belt 201 stops rotating, the excessive temperature rise can be detected early, whereby peripheral members can be prevented from being damaged.

Figure 13:
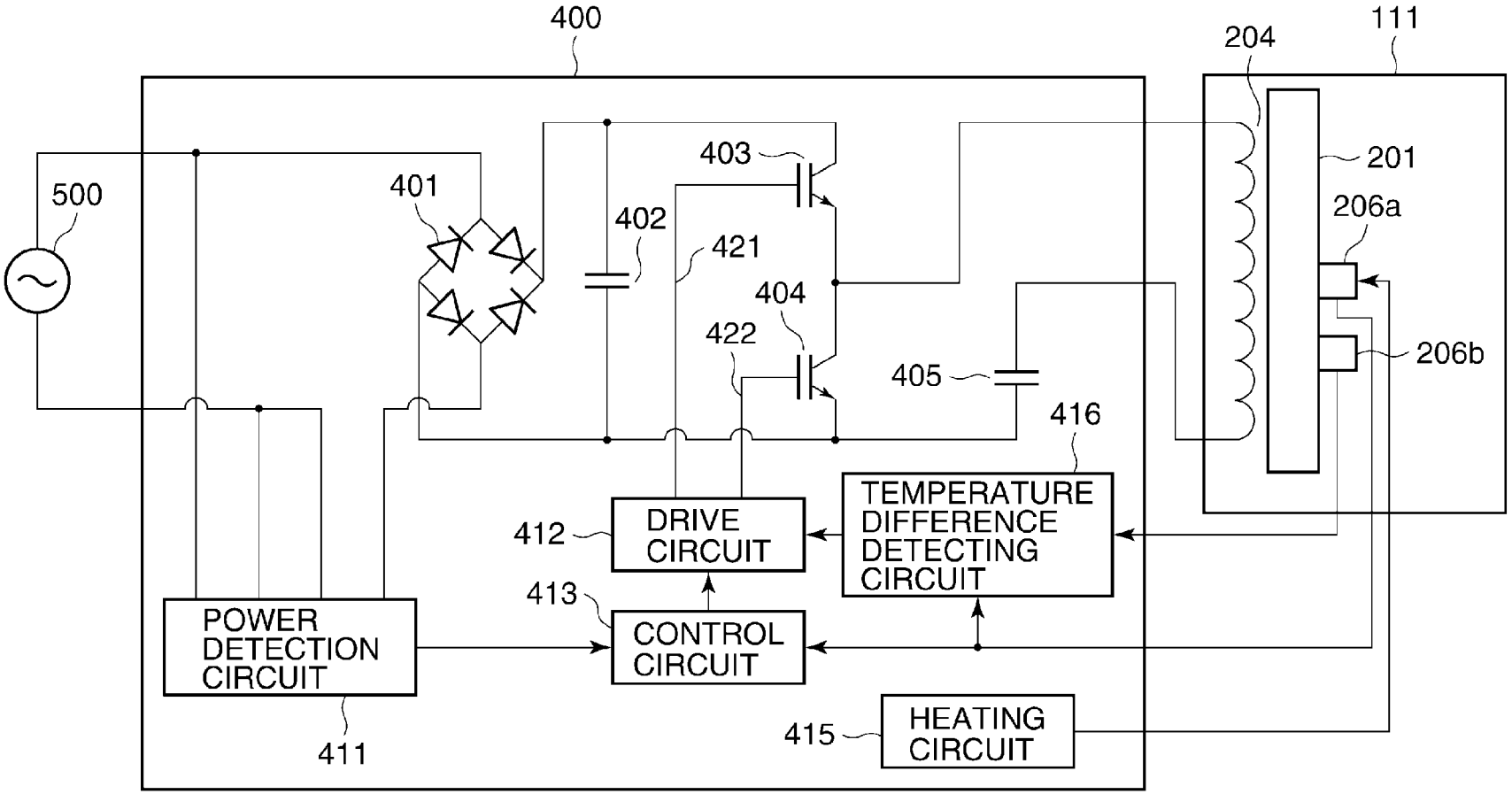
FIG. 13 is a block diagram showing a fixing controller according to a second embodiment of this invention.

FIG. 13 shows in block diagram a fixing controller according to a second embodiment of this invention.

In the fixing controller of the second embodiment, a plurality of, e.g., two thermistors 206*a*, 206*b* are disposed close to each other along the belt 201, as shown in FIG. 13. Among these, only the thermistor 206*a* is heated by the heating circuit 415 such that a predetermined or greater temperature difference is produced between the temperatures respectively detected by the thermistor 206*a* when the belt 201 is rotating and when the belt 201 stops rotating, as with the first embodiment.

Figure 14:
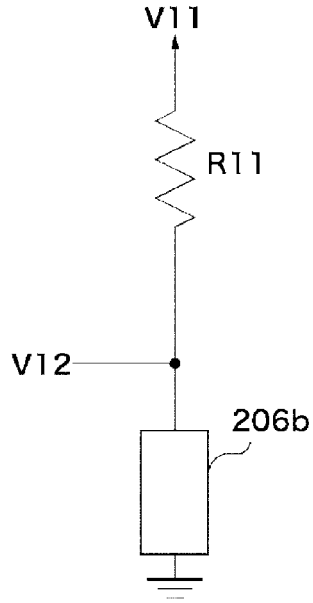
FIG. 14 is a view showing an example connection of one of thermistors in FIG. 13.

FIG. 14 shows an example connection of the thermistor 206*b* shown in FIG. 13.

A resistor R11 is connected in series with the thermistor 206*b* and connected to a reference voltage V11. The resistor R11 has a resistance of, e.g., 4.3 kΩ, and the reference voltage V11 has a value of, e.g., 3.3 V. The temperature detected by the thermistor 206*b* not heated by the heating circuit 415 becomes equal to the temperature of the belt 201 irrespective of whether the belt 201 is rotating or stops rotating.

The power unit 400 is mounted with a temperature difference detecting circuit 416 instead of the excessive temperature rise detecting circuit 414 (FIG. 4) in the first embodiment. The temperature difference detecting circuit 416 is configured to detect a difference between temperatures respectively detected by the thermistors 206*a*, 206*b*. In a case where a potential difference between V2 and V12 becomes equal to or greater than a predetermined difference, i.e., in a case where a difference between temperatures respectively detected by the thermistors 206*a*, 206*b* becomes equal to or greater than a predetermined temperature difference (8 degrees C. in this example), the temperature difference detecting circuit 416 determines that the belt 201 stops rotating, and stops the supply of AC current to the coil 204.

Figure 15:
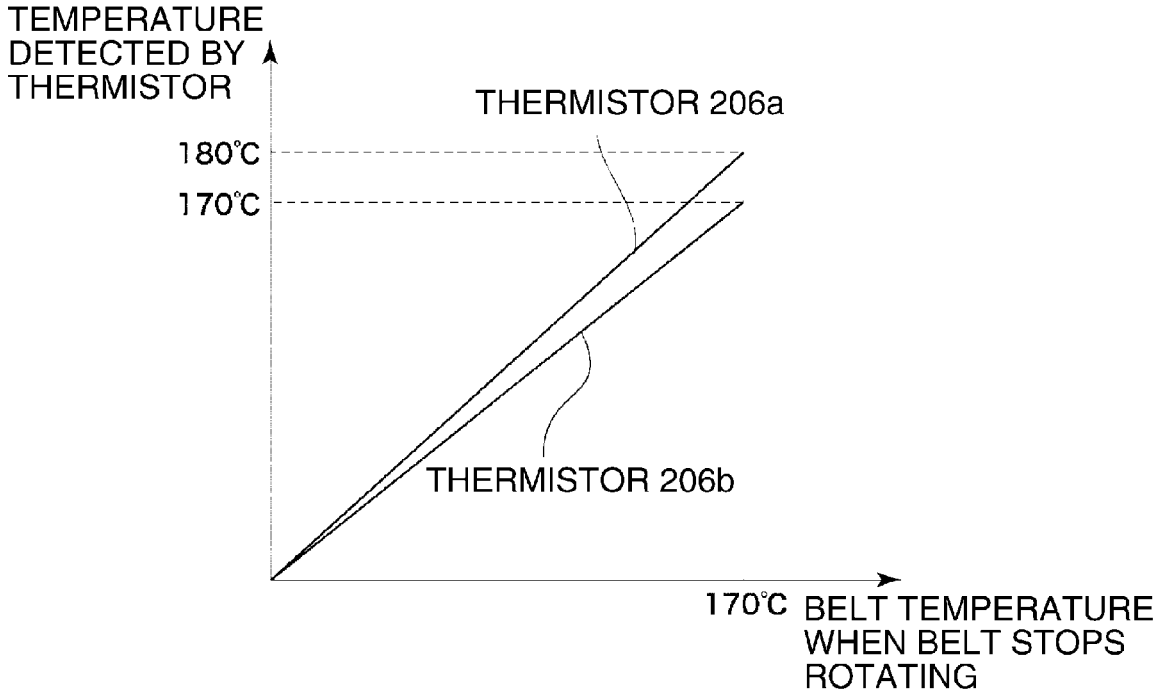
FIG. 15 is a graph showing an example relationship between belt temperature and temperatures detected by the thermistors.

When the belt 201 stops rotating in a case where the temperature of the belt 201 is controlled to 180 degrees C., the temperature detected by the thermistor 206*a* becomes about 10 degrees C. higher than the temperature detected by the thermistor 206*b* according to the characteristic shown in FIG. 15. It is therefore possible to determine whether the belt 201 is rotating or stops rotating.

Specifically, in this embodiment, the thermistor 206*a* is heated by the heating circuit 415 such that the difference between the temperatures respectively detected by the thermistors 206*a*, 206*b* when the belt 201 is rotating becomes smaller than the predetermined temperature difference, whereas the difference between the temperatures detected by the thermistors 206*a*, 206*b* when the belt 201 stops rotating becomes equal to or larger than the predetermined temperature difference. When the difference between the temperatures detected by the thermistors 206*a*, 206 becomes equal to or larger than the predetermined temperature difference, the current supply to the coil 204 is stopped to prevent peripheral members from being damaged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-294427, filed Nov. 18, 2008, which is hereby incorporated by reference herein in its entirety.

What is claimed is:

1. A fixing controller comprising:

a first heating unit configured to heat a rotor of a fixing unit;

a temperature detecting unit configured to detect a temperature of the rotor at its portion heated by said first heating unit;

a second heating unit configured to heat said temperature detecting unit; and a control unit configured to stop said first heating unit from heating the rotor in a case where the temperature detected by said temperature detecting unit becomes equal to or higher than a predetermined temperature, wherein said temperature detecting unit is heated by said second heating unit such that a difference between the temperatures respectively detected by said temperature detecting unit when the rotor is rotating and when the rotor stops rotating becomes equal to or larger than a predetermined temperature difference.

2. The fixing controller according to claim 1, wherein said first heating unit is an induction heating coil configured to generate a high frequency magnetic field by being applied with high frequency electric power.

3. An image forming apparatus including the fixing controller as set forth in claim 1.

4. A fixing controller comprising:

a first heating unit configured to heat a rotor of a fixing unit;

a plurality of temperature detecting units each configured to detect a temperature of the rotor at its portion heated by said first heating unit;

a second heating unit configured to heat one of said plurality of temperature detecting units; and a control unit configured to stop said first heating unit from heating the rotor in a case where a difference between the temperatures respectively detected by said plurality of temperature detecting units becomes equal to or greater than a predetermined temperature difference, wherein the one of said plurality of temperature detecting units is heated by said second heating unit such that the difference between the temperatures respectively detected by said plurality of temperature detecting units when the rotor stops rotating becomes equal to or greater than the predetermined temperature difference.

5. The fixing controller according to claim 4, wherein the one of said plurality of temperature detecting units is heated by said second heating unit such that a difference between the temperatures respectively detected by the one of said plurality of temperature detecting units when the rotor is rotating and when the rotor stops rotating becomes equal to or larger than a temperature difference corresponding to the predetermined temperature difference.

6. An image forming apparatus including the fixing controller as set forth in claim 4.

* * * * *